United States Patent [19]

Konstant

[11] 3,971,476

[45] July 27, 1976

[54] RAIL-CARRYING STORAGE RACKS

[75] Inventor: Anthony N. Konstant, Mount Prospect, Ill.

[73] Assignee: Speedrack Inc., Skokie, Ill.

[22] Filed: Nov. 20, 1974

[21] Appl. No.: 525,392

[52] U.S. Cl. ..... 211/134; 52/658

[51] Int. Cl.[2] ..... A47F 5/00

[58] Field of Search ..... 211/134, 148, 151, 176, 211/177; 248/226 A; 108/108, 109, 110, 111; 52/648, 653, 658

[56] References Cited

UNITED STATES PATENTS

| | | | |
|---|---|---|---|
| 1,678,990 | 7/1928 | Mansfield | 248/226 A |
| 2,894,641 | 7/1959 | Edwards | 211/134 |
| 2,968,409 | 1/1961 | Jurechko | 211/134 |
| 3,151,745 | 10/1964 | Reilly | 211/177 |
| 3,158,265 | 11/1964 | Thimons | 211/177 |
| 3,305,998 | 2/1967 | Deisenroth | 52/658 |
| 3,323,655 | 6/1967 | Foran et al. | 211/176 |
| 3,478,483 | 11/1969 | Baker | 52/658 |
| 3,785,502 | 1/1974 | Konstant | 211/134 |

FOREIGN PATENTS OR APPLICATIONS

| | | | |
|---|---|---|---|
| 164,253 | 7/1955 | Australia | 52/658 |

*Primary Examiner*—Roy D. Frazier
*Assistant Examiner*—Robert A. Hafer
*Attorney, Agent, or Firm*—Fitch, Even, Tabin & Luedeka

[57] ABSTRACT

A storage rack for holding superposed loads of palletized goods for use with a stacker crane or the like. Parallel upright trusses are spaced apart to define storage bays therebetween, and compartments within the bays are provided by rails carried by the trusses. U-shaped members connected to the columns of the trusses constitute parallel rails extending, respectively, into adjacent storage bays. Rectangular tubes may be crush-bent to the desired U-shape and connected by welds and/or brackets or supports to the columns of the trusses.

9 Claims, 5 Drawing Figures

RAIL-CARRYING STORAGE RACKS

BACKGROUND OF THE INVENTION

This invention relates generally to storage racks and more particularly to storage rack installations designed for use with a stacker crane which transports palletized loads to and from the storage rack bays.

Storage rack installations are increasingly being designed for use with more mechanized handling systems of palletized materials being warehoused, and various of these systems have been accompanied by computer control arrangements wherein a stacker crane is programmed to automatically retrieve a palletized load from a particular vertical location in a storage bay. Generally, these installations have been constructed to provide one main aisle in a warehouse with a large number of parallel side aisles extending in at least one direction from the main aisle. The storage rack installations are located in the regions between the parallel side aisles and provide storage bays facing both edges of each side aisle.

To facilitate such stacker crane operations, the storage bays are generally constructed so as to have a depth which will accommodate one or two palletized loads, with superposed loads being accommodated at predetermined vertical intervals within each storage bay, from the floor to the ceiling of the warehouse. Accordingly, the storage rack installations are normally arranged in back-to-back relation, with the open fronts facing both edges of each side aisle.

The individual storage bays are defined by vertical truss members which extend fore-and-aft (with respect to the direction of insertion and removal of the palletized loads), and these trusses support parallel, horizontal rails which extend a sufficient distance into the storage bays, at the predetermined vertical levels, to support the lateral edges of a pallet. These rails have heretofore been supported by suitable brackets attached to each side of the columns which form the trusses or in some instances have been fabricated with integral brackets that permit them to be bolted directly to the side surfaces of the truss columns. Because of the multitude of relatively short (i.e., one or two pallet lengths deep) rails which are required in a sizable stacker crane installation, the erection costs of such storage rack installations has been considerable.

SUMMARY OF THE INVENTION

It has been found that substantial improvements are effected in fabrication and erection of storage rack installations of this type by forming both rails which flank an upright truss at a particular vertical location from a single structural member. As a result, not only does the attachment of one structural member effect the installation of two parallel rails which extend into different storage bays, but the integral design allows considerable simplification in the attachment of the rails to the truss columns which is also a substantial advantage. Moreover, the design facilitates the spacing of rails at greater distances into the storage bays from the columns where they can support pallets of different widths.

DESCRIPTION OF THE PREFERRED EMBODIMENTS

Figure 1:
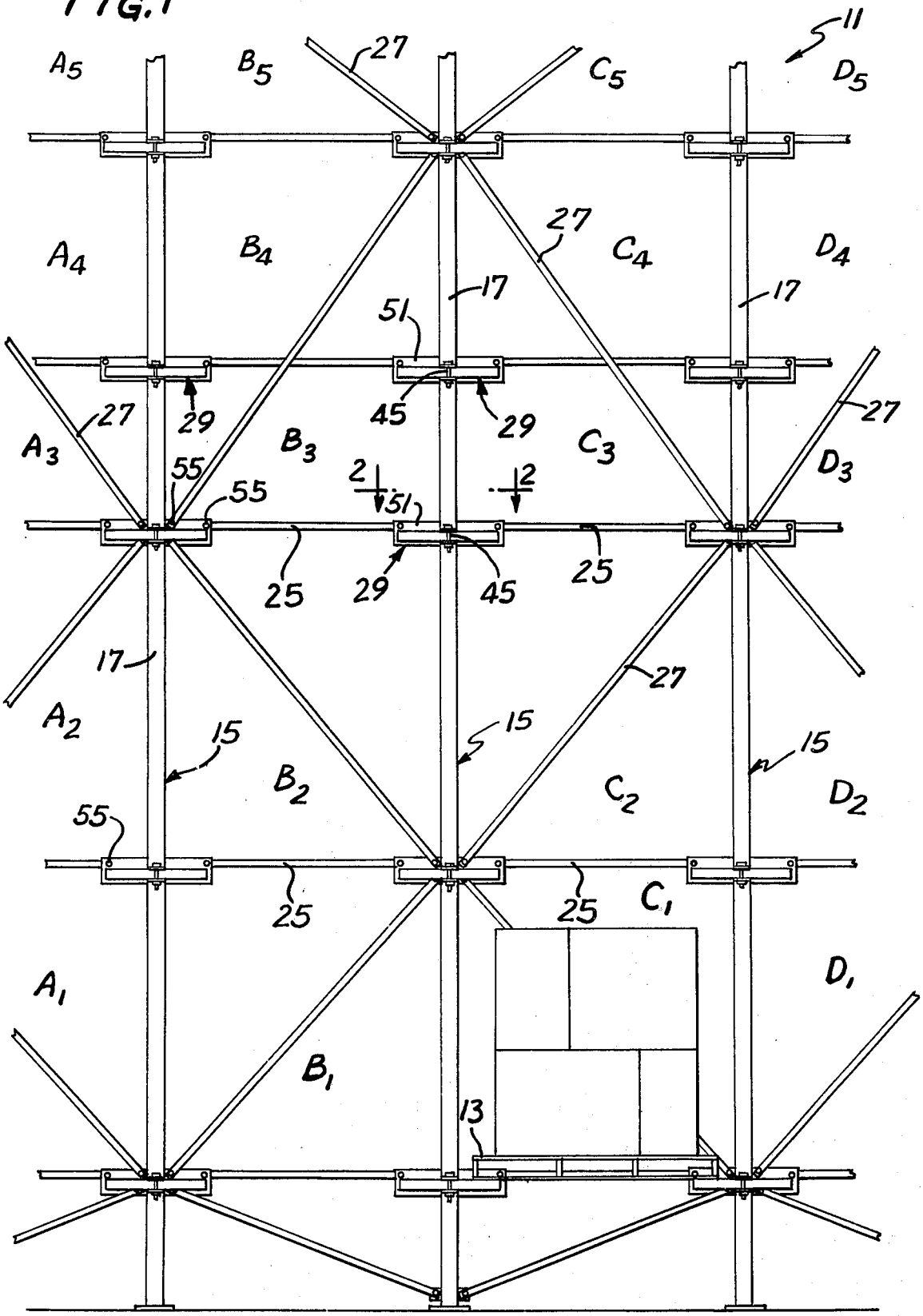
FIG. 1 is a partial front elevation view of a storage rack installation embodying various features of the invention, as seen from a side aisle from which access to the storage bays is provided.

FIG. 1 of the drawings depicts a portion of a storage rack installation 11 designed for service by a stacker crane (not illustrated) or the like. The installation 11 is depicted as looking in a fore-and-aft direction, i.e., looking directly into the storage bays from a side aisle, and it should be understood that there would be similar installation located at the opposite edge of the side aisle facing the illustrated installation. The storage rack installation 11 provides a number of side-by-side storage bays which are marked for purposes of reference as A,B,C and D in FIG. 1. Each storage bay is designed to accommodate a plurality of superposed palletized loads in individual storage compartments, e.g., $A_1$,$A_2$,$A_3$, etc. Each storage compartment is defined generally by a pair of parallel rails which are spaced apart an appropriate distance to support the lateral edges of a pallet 13 carrying the load that is being stored. Although the compartments, e.g., $B_2$ and $B_3$, in a particular storage bay are constructed to have different heights to accommodate loads of different size, they could, of course, be made uniform in size.

Basically, the storage rack installation 11 comprises a plurality of parallel upright trusses 15 which stand upon the warehouse floor and extend upward usually to a point near the roof or as high as the stacker crane is designed to operate. The trusses 15 are fabricated from front columns 17 and rear columns 19, which may be tubular in shape, and which are joined together by horizontal spacers 21 that are usually welded thereto. Diagonal or X-bracing 23 is affixed throughout the height of the trusses, and this bracing 23 may be welded either to the columns 17,19 themselves or to the horizontal spacers 21.

The stacker crane operation in storage rack installation 11 designed to warehouse heavy loads, e.g., asphalt shingles, will dictate that the storage bays have a depth sufficient to accommodate a single pallet, as in the illustrated example; however, for storage of relatively light loads, an installation will often be constructed for storing two pallets deep. Thus, the illustrated truss 15 is usually only about 40 inches in depth, although it may extend as high as 45 to 50 feet, or even higher, depending upon the particular warehouse. Of course, trusses 15 greater than about 40 feet high are generally fabricated in sections of an appropriate length to facilitate normal shipment and then joined at the installation. Adjacent trusses 15 are interconnected at the rear of the storage bays, usually by horizontal tie bars 25 that are attached in some manner, either directly or indirectly, to the rear columns 19. Likewise, stability throughout the installation is created by providing diagonal braces 27 which may connect either to the horizontal tie bars 25 or to the rear columns 19 themselves. The rear columns 19, tie bars 25 and diagonal braces 27 constitute the rear boundary of the storage bays.

Figure 2:
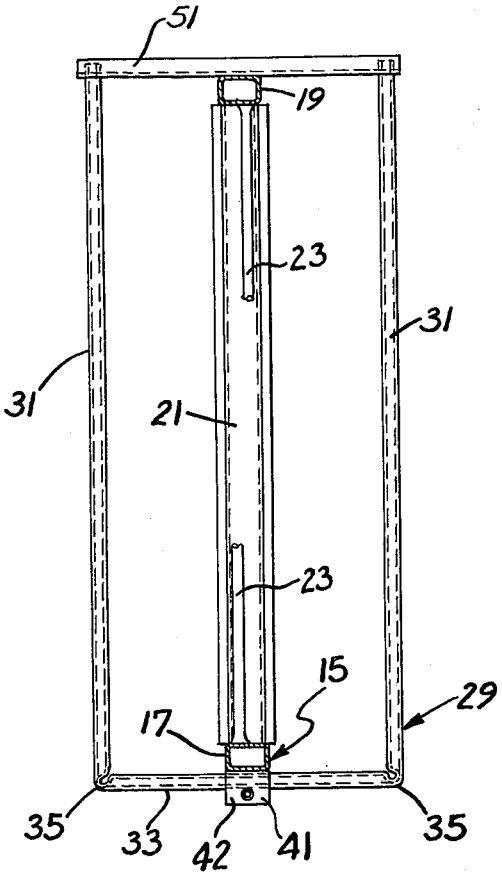
FIG. 2 is a sectional view, enlarged in size, looking downward along the line 2—2 of FIG. 1.
Figure 4:
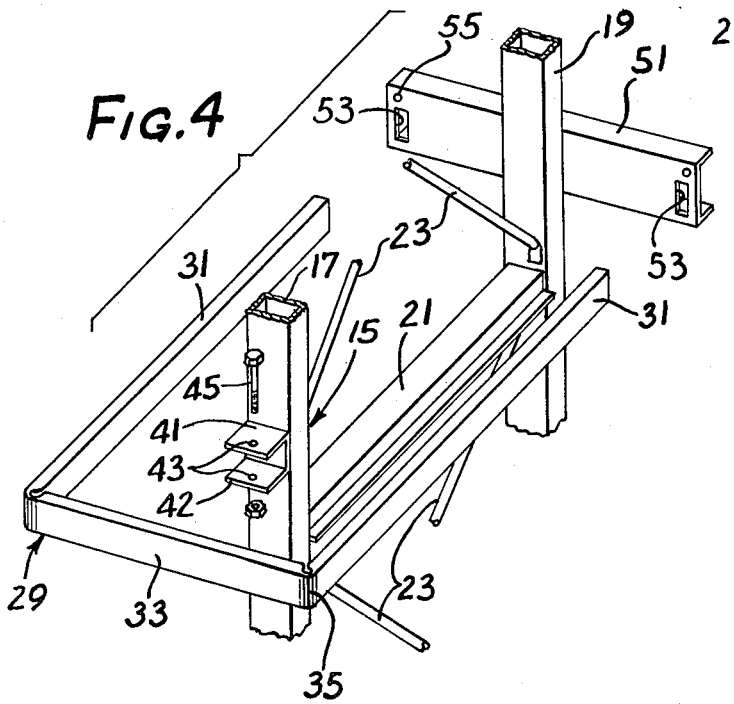
FIG. 4 is an exploded perspective view of the portion of the storage rack installation illustrated in FIGS. 2 and 3.

An improved rail design is provided, as best seen in FIGS. 2 and 4, by crush-bending a tube of rectangular cross section to a U-shape 29 which provides a pair of parallel rails 31 interconnected by a perpendicular central leg 33. The excellent stability and stiffness that results from the employment of such an integral member permits the rails 31 to be adequately supported by merely connecting the perpendicular leg 33 to the front column 17 at a point near the mid-point thereof, and it also allows the rails 31 to be spaced a substantial distance from the columns when desired. To assure the desired rigidity and beam strength, a rectangular cross section tube is preferably chosen for the U-shape 29 wherein the height of the tube is at least one-third greater than its width thereof, and in installations where the rails are fairly long, the height may be as great as three times the width. Crush-bending is carried out by making a pair of indentations into the tube wall at locations which will constitute corners 35 of the U-shape 29 and then bending the tube toward the indentations so as to cause crushing of the upper and lower walls of the tube to occur at these precise points.

Figure 3:
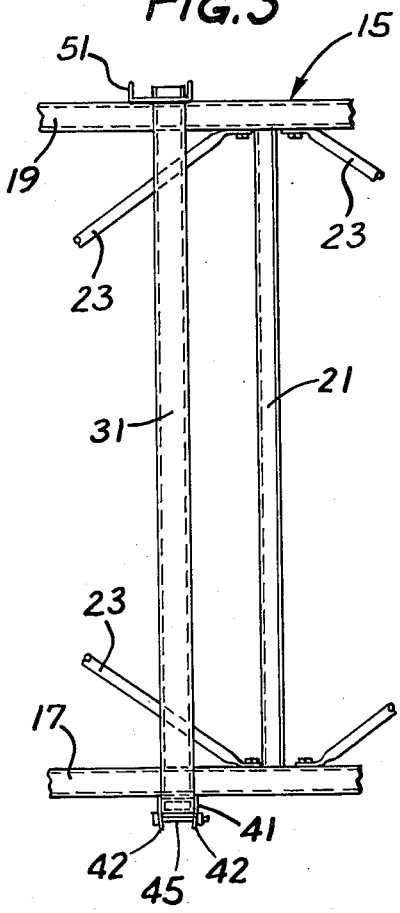
FIG. 3 is a side elevation view of the fragmentary structure illustrated in FIG. 2.

In the illustrated preferred embodiment, suitable brackets 41 are affixed to the front column 17 of each truss at the desired vertical intervals, which brackets will support the perpendicular leg sections 33 of the combined rail members. In the illustrated embodiment, the bracket 41 comprises a short section of channel welded to the front face of the column 17, which channel has a web just slightly greater than the height of the rectangular tube and which has flanges 42 which are substantially deeper than the width of the tube. Accordingly, the perpendicular leg section 33 of the U-shaped rail combination is received between the flanges of the channel bracket 41, as shown in FIG. 3. The U-shaped member 29 is locked in position by providing aligned holes 43 in the flanges of the channel bracket 41 through which a pin member 45, preferably a threaded bolt, can be inserted and secured by a nut. The nut is preferably tightened on the bolt 45 to such an extent that the flanges 42 just begin to bend around the tube, thus immobilizing it within the bracket and also transferring part of the load from the lower flange 42 to the upper flange 42.

Support for the free rear ends of the rails 31 is provided by suitably interconnecting them with the rear column 19 of the truss 15. In the illustrated embodiment, a laterally extending support 51 is welded to the rear surface of the rear column 19, which support is in the form of a shallow channel; however, it could have other shapes. As best seen in FIG. 4, the lateral support 51 is provided with a pair of rectangular apertures 53 proportioned and located so as to receive the free ends of the rail sections 31 of the U-shaped member, which rails rest upon the lower edges of the rectangular apertures. The rectangular shape of the apertures 53 and the close proportioning to the dimensions of the tubular rail provide support for the rails against twisting. Other smaller apertures 55 in the lateral support 51 provide locations for connection to the horizontal tie rods 25 and to the diagonal braces 27 which extend between adjacent trusses 15.

As a result of this construction, erection at the warehouse site is substantially simplified by permitting the rails to be installed by simply aligning the mid-point region of the perpendicular leg 33 with the front bracket 41 and then sliding the U-shaped member 29 rearward so that the free ends of the rectangular tube enter the rectangular holes 53 provided in the rear support 51. Once in position, a bolt 45 is dropped through the holes 43 in the flanges 42 of the bracket 41 and secured by a nut, which is preferably tightened to the point where slight bending of the bracket flanges occurs. It can be seen that this installation, which requires only a single connection at the front bracket, greatly simplifies erection time and, when multiplied by the multitude of rails required in a storage rack installation 11, results in a very substantial saving in labor cost.

Figure 5:
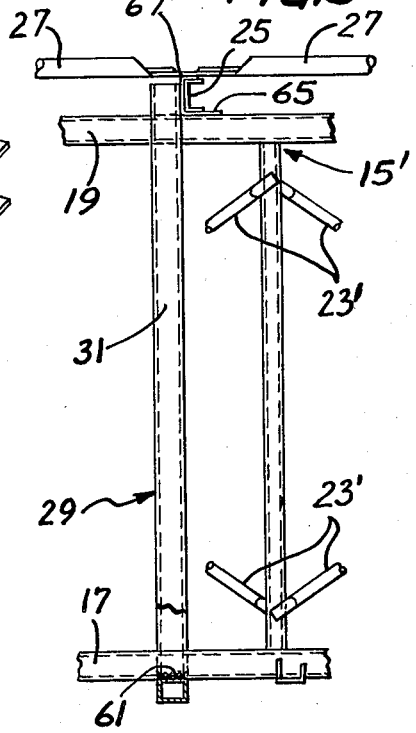
FIG. 5 is a side elevation view similar to FIG. 3 showing an alternative embodiment of a storage rack installation embodying various features of the invention.

Depicted in FIG. 5 is an alternative embodiment of the combination rail arrangement which is designed for an installation that can be shipped to the warehouse site with the rails 31 already affixed in position on an upright trus 51'. The truss 15' has a spacer 21' of tubular shape to which X-bracing 23' is welded. The U-shaped rail member 29 is fabricated in the same manner as previously indicated; however, it is welded directly to the front surface of the front column 17 of the truss 15, as by providing lines of weld 61 joining the corner edges of the front column 17 to the rear surface of the perpendicular leg 33. Alternatively, the upper and lower surfaces of the leg could be welded to the column front face.

A rear support 65 is constituted by a laterally extending piece of J-shape, but which could be an angle iron or some other suitable shape. The front surface of a vertical flange of the support 65 is welded to the rear surface of the rear column 19 of the truss, or to the corner edges thereof, at a suitable height to provide a horizontal surface 67 upon which the rails 31 may rest. The J-shape support 67 is proportioned to accommodate the horizontal tie bars 25 therewithin, and the diagonal bracing 27 may be affixed to the rear flange of the support. The free ends of the two rails 31 of the U-shaped member 29 are suitably welded to the upper surface 67 of the flange of the J-shape support upon which they rest. The improved U-shape rail member 29 has sufficient rigidity and stiffness to permit this direct affixation to the upright trusses; and because there is no installation of the rails required at the warehouse, the time and cost of erection is even further reduced. Of course, the shipping costs become a consideration which will likely limit this alternative type of construction to installations wherein the rails are spaced fairly close to the columns of the truss.

Modifications of the structure herein described which would be obvious to those having the ordinary skill in the art are considered as falling within the scope of the invention, which is defined solely by the appended claims. For example, if it is desired to minimize welding operations, the support 51 can be substituted for the support 67 while retaining the front welded connection 61, thus eliminating the welds between the free ends of the rails and the support. Various features of the invention are set forth in the claims that follow.

What is claimed is:

1. A storage rack for holding superposed loads of palletized goods which comprises a plurality of upright trusses each of which contains parallel vertical columns which are interconnected by spacers rigidly affixed thereto, said trusses being arranged in parallel fore-and-aft extending planes and being laterally spaced apart from one another to define a plurality of storage bays therebetween, plurality of U-shaped load support members carried by each of said trusses at vertical intervals thereupon, each of said load supports constituting a pair of substantially parallel rails interconnected by an integral leg, each said U-shaped load support being a tube of rectangular cross section which is formed with a substantially right-angle crush-bend at each corner between said leg and each rail, first means connecting the central portion of each said leg to one of said columns and second means connecting the ends of said rails opposite from said leg to another said column in said fore-and-aft extending plane whereby rails on trusses in adjacent fore-and-aft extending planes extend into the storage bay defined thereby and provide support for palletized loads in superposed relation to one another.

2. A storage rack in accordacne with claim 1 wherein said trusses each contain a plurality of vertically-spaced supports which extend laterally outward from said other column for supporting the rail portions of said U-shaped members at different vertical levels and which constitute said second connecting means, said rails each resting upon said supports at a location near the free ends thereof.

3. A storage rack in accordance with claim 2 wherein said first connecting means comprises weld means joining said leg at about its midpoint to said one column and wherein said rails are welded to said laterally-extending supports.

4. A storage rack in accordance with claim 2 wherein each said laterally extending support includes a pair of rectangular openings proportioned to receive and totally circumscribe the free ends of said rails.

5. A storage rack in accordance with claim 4 wherein said first connecting means comprises bracket means affixed to said one column and pin means retaining said leg within said bracket.

6. A storage rack in accordance with claim 5 wherein said bracket comprises a channel, the vertical web of which is affixed to said column.

7. A storage rack in accordance with claim 1 wherein the vertical dimension of said rectangular tube is at least one-third greater than the horizontal dimension thereof.

8. A storge rack in accordance with claim 1 wherein said other columns of said trusses are structurally interconnected to one another by laterally extending members and constitute the rear boundary of said storage rack.

9. A storage rack in accordance with claim 6 wherein said bracket has upper and lower flanges which have apertures at locations spaced from said web a greater distance than the width of said tube and wherein said pin means is received in said apertures and comprises a bolt having a nut tightened sufficiently upon its threaded end to bend the portions of said flanges lying outward of said tube.

* * * * *